US005247994A

United States Patent [19]

Nenniger

[11] Patent Number: 5,247,994

[45] Date of Patent: Sep. 28, 1993

[54] METHOD OF STIMULATING OIL WELLS

[76] Inventor: John E. Nenniger, 4512 Charleswood Dr. NW., Calgary, Alberta, Canada, T2L 2E5

[21] Appl. No.: 972,682

[22] Filed: Nov. 6, 1992

Related U.S. Application Data

[63] Continuation of Ser. No. 767,704, Sep. 30, 1991, Continuation-in-part of Ser. No. 590,755, Oct. 1, 1990, Pat. No. 5,120,935.

[51] Int. Cl.[5] ..... E21B 36/04; H05B 3/02; H05B 3/78

[52] U.S. Cl. ..... 166/303; 166/60; 166/64; 166/65.1; 166/304; 219/415; 392/305

[58] Field of Search ..... 166/304, 303, 302, 60, 166/65.1, 64, 53; 392/305, 301

[56] References Cited

U.S. PATENT DOCUMENTS

| | | |
|---|---|---|
| 47,410 | 4/1865 | Fraser . |
| 231,287 | 8/1880 | Digman et al. . |
| 457,457 | 8/1891 | Robison et al. . |
| 522,737 | 7/1894 | Lucock . |
| 573,142 | 12/1896 | Flanegin . |
| 762,628 | 6/1904 | Gardner . |
| 766,313 | 8/1904 | Yoast . |
| 780,279 | 1/1905 | Gardner . |
| 784,454 | 3/1905 | Waring . |
| 884,424 | 4/1908 | Seymour et al. . |
| 972,308 | 10/1910 | Williamson . |
| 1,082,971 | 12/1913 | Pick . |
| 1,095,365 | 5/1914 | Williamson . |
| 1,169,262 | 1/1916 | Huff . |
| 1,232,736 | 7/1917 | Truman et al. . |
| 1,360,404 | 11/1920 | Hollister et al. . |
| 1,368,404 | 2/1921 | Loftus . |
| 1,383,670 | 7/1921 | Stephens . |
| 1,426,407 | 8/1922 | Pennington . |
| 1,450,658 | 4/1923 | Warnick . |
| 1,457,690 | 6/1923 | Brine . |
| 1,464,618 | 8/1923 | Pershing . |
| 1,477,802 | 12/1923 | Beck . |

(List continued on next page.)

FOREIGN PATENT DOCUMENTS

| | | |
|---|---|---|
| 1182392 | 2/1985 | Canada . |
| 2504187 | 10/1982 | France . |
| 827757 | 5/1981 | U.S.S.R. . |
| 8810356 | 12/1988 | World Int. Prop. O. . |

OTHER PUBLICATIONS

Nathan C. C., "Solubility Studies of High Moleculare Weight Paraffin Hydrocarbons Obtained from Petroleum Rod Waxes", Petroleum Transactions of the AIME; vol. 204, 1955 pp. 151 to 155.

(List continued on next page.)

*Primary Examiner*—Stephen J. Novosad
*Attorney, Agent, or Firm*—Bereskin & Parr

[57] ABSTRACT

This invention describes a method of stimulating production from an oil well by removing solid wax deposits from a production zone. An electrical resistance heater comprised of a packed bed of spherical heating elements is lowered through the tubing on a wireline and placed adjacent to the perforations. Solvent is pumped through the heater to raise its temperature by 200° C. and then into the formation to contact wax deposits. The solid wax deposits are liquified and together with the oil and the solvent form a single liquid phase. The wax is then removed from the formation by placing the well back on production. Because the invention completely avoids the use of either water or gas, the saturation of the water and gas phases in the formation is minimized, thereby maximizing the mobility of the liquid phase containing the wax and facilitating the removal of the liquified wax from the treatment area before it reprecipitates. The packed bed heater has a large surface area and a large heat transfer coefficient, so high power rates (150 kW) can be achieved within a compact volume (6 m long × 5 cm id) without solvent degradation. By heating the solvent to a high temperature, a minimum volume of solvent is required, thereby minimizing production downtime and solvent costs. The burnout and catastrophic failure problem usually associated with resistive heaters is avoided due to the multiplicity of current paths through the packed bed.

18 Claims, 5 Drawing Sheets

U.S. PATENT DOCUMENTS

| | | | |
|---|---|---|---|
| 1,504,208 | 8/1924 | Brine . | |
| 1,540,648 | 6/1925 | Pershing . | |
| 1,646,599 | 10/1927 | Schaefer . | |
| 1,672,200 | 6/1928 | Buck . | |
| 1,690,994 | 11/1928 | Powell . | |
| 1,701,884 | 2/1929 | Hogle . | |
| 1,761,227 | 6/1930 | Pasley . | |
| 1,776,997 | 9/1930 | Downey . | |
| 1,839,632 | 1/1932 | Agnew . | |
| 2,202,034 | 5/1940 | Thomas . | |
| 2,208,087 | 7/1940 | Somers . | |
| 2,244,256 | 6/1941 | Looman . | |
| 2,260,916 | 10/1941 | Rial . | |
| 2,332,708 | 10/1943 | Freeman . | |
| 2,484,063 | 10/1949 | Ackley . | |
| 2,500,305 | 3/1950 | Ackley . | |
| 2,632,836 | 3/1953 | Ackley . | |
| 2,660,249 | 11/1953 | Jakosky . | |
| 2,666,487 | 1/1954 | Bowman . | |
| 2,685,930 | 8/1954 | Albaugh . | |
| 2,808,110 | 10/1957 | Spitz . | |
| 2,836,248 | 5/1958 | Covington . | |
| 2,998,066 | 8/1961 | Nixon, Sr. . | |
| 3,163,745 | 12/1964 | Boston . | |
| 3,279,541 | 10/1966 | Knox et al. . | |
| 3,410,347 | 11/1968 | Triplett et al. . | |
| 3,437,146 | 4/1969 | Everhart et al. | 166/304 X |
| 3,438,444 | 4/1969 | Wilkerson | 166/304 |
| 3,493,050 | 10/1970 | Kelley . | |
| 3,614,986 | 10/1971 | Gill . | |
| 3,945,436 | 3/1976 | Nebolsine . | |
| 3,951,828 | 4/1976 | Plummer | 166/304 |
| 4,178,993 | 12/1979 | Richardson et al. . | |
| 4,219,083 | 8/1980 | Richardson . | |
| 4,285,401 | 8/1981 | Erickson . | |
| 4,330,037 | 5/1982 | Richardson et al. . | |
| 4,399,868 | 8/1983 | Richardson et al. | 166/304 |
| 4,790,375 | 12/1988 | Bridges et al. | 166/304 X |
| 4,911,239 | 3/1990 | Winckler et al. | 166/304 X |

OTHER PUBLICATIONS

Nelson T. W., and McNiel, Jr., "Oil Recovery by Thermal Methods", The Petroleum Engineer, pp. B-27 to B-32 (Feb., 1959).

White, P. D. and Moss, J. T., "High-Temperature Thermal Techniques for Stimulating Wells", Journal of Petroleum Technology, pp. 1007-1011, (Sep., 1965).

R. Van A. Mills, The Paraffin Problem in Oil Wells, Dec. 1932.

John Power, Removing Paraffin Deposits from Wells with Electric Heater, 1928.

L. G. E. Bignell Electric Heaters Remove Paraffin, Nov. 14, 1929.

C. E. Reistle, Jr. and O. C. Glade, Paraffin and Congealing-Oil Problems, 1932.

Frank V. Eaton, Applications of Heat Increases Production in Wyoming Field, Apr. 22, 1943.

F. R. Cozzens, Sand Face Cleaning with Lye, Aluminum and Oil, Aug. 1948.

H. E. Allen and R. K. Davis, Electric Formation Heaters and Their Application, Apr. 1954.

K. G. Parrent, Bottom Hole Heaters, May 1955.

World Oil, AC Current Heats Heavy Oil for Extra Recovery, May 1970.

Dr. S. M. Farouq Ali, Well Stimulation by Downhole Thermal Methods, Oct. 1973.

D. L. Currans, Electroflood Proves Technically Feasible, Jan. 1980.

David R. Davies, Edwin A. Richardson and Dan Antheunis, Field Applications of In-Situ Nitrogen Gas Generation System, Mar. 1981.

Products and Methods Bulletin Chemical Unit Field Application of a Chemical Heat and Nitrogen Generating System, Mar. 1984.

H. W. McSpadden, M. L. Tyler and T. T. Velasco, In-Situ Heat and Paraffin Inhibitor Combination Prove Cost Effective in NPR #3, Cooper, Wyo., Apr. 1986.

J. P. Ashton, L. J. Kirspel, H. T. Nguyen & D. L. Credeur, In-Situ Heat System Stimulates Paraffinic Crude Producers in Gulf of Mexico, Oct. 1986.

Edward T. Yukl & Andrew W. Marr, Jr., Process Solves Paraffin Buildup in Tubing, Aug. 8, 1988.

John Nenniger & Gina Nenniger, Optimizing Hot Oiling/Watering Jobs to Minimize Formation Damage, 1990.

Petrotherm Electric Bottom-Hole Heating System (undated).

METHOD OF STIMULATING OIL WELLS

RELATED CASES

This application is a Continuation of application Ser. No. 07/767,704 dated Sep. 30, 1991 and a Continuation-in-Part of application Ser. No. 07/590,755 dated Oct. 1, 1990 now U.S. Pat. No. 5,120,935.

FIELD OF THE INVENTION

This invention relates generally to the field of extraction of hydrocarbons, such as oil, gas and condensates, from underground reservoirs. More particularly, this invention relates to the stimulation and enhancement of production or recovery of such hydrocarbons from such reservoirs.

BACKGROUND OF THE INVENTION

Much of our current energy needs are met through use of hydrocarbons, such as oil, natural gas, and condensates, which are recovered from naturally occurring deposits or reservoirs. Typically, such hydrocarbons are in a liquid or gas phase in the reservoir. Liquid hydrocarbons are often produced by pumping them from the reservoir to storage tanks or a flow line connected to the wellhead. The pumping or "lifting" costs include capital costs, such as the pump, the prime mover (i.e., motor), the rods and the tubing, and operating costs, such as labour, royalties, taxes, and electricity. Because some of these costs are fixed, a certain production rate is required to make such recovery economically feasible. If the revenue generated by selling the recovered hydrocarbons is less than the lifting costs to so recover them, then the well may be temporarily closed up or permanently shut in. In some cases wells may be reopened when new, technology becomes available, and in other cases the well may be reopened if energy prices rise, once again making production and recovery economically attractive. Alternatively, a permanently shut-in well would be plugged with concrete and abandoned altogether.

Typically, an oil well will be shut in or abandoned when only 20–50 percent of the total oil in the reservoir is recovered, because it becomes uneconomic to continue to operate the well. This unrecovered oil has been recognized as a lost resource in the past and thus there have been many techniques proposed to stimulate production rates and consequently increase the ultimate recovery of oil from reservoirs.

There are a number of reasons why oil and gas well productivity may decline over time. For example, productivity declines if (1) there is insufficient pressure differential between the well and the reservoir, (2) the flow between the reservoir and the well is obstructed, or (3) the mobility of the oil is restricted due to relative permeability effects. Conventional production practice, such as waterflooding, gas re-injection and the like, is effective for maintaining reservoir pressure to overcome the first problem. Many different phenomena can result in impediments to the flow of fluid hydrocarbon from the reservoir to the wellbore. For example, there may be precipitation of mineral scales, such as calcite, anhydrite or the like, in the formation, the perforation tunnels (located at the bottom of the well) or the wellbore. There may be mobile inorganic fines, such as clay or sand, which are carried by the flow of the fluid being recovered into narrow pore throats thereby blocking them. There may be clay minerals which swell under the influence of recovery and which therefore result in flow path restrictions and a flow reduction. There may be an alteration of the saturation of a particular phase of the well. For example, in a low permeability reservoir with a very low water content, damage can be caused if water contacts the reservoir. The damage occurs as a reduction in the relative permeability (i.e., mobility) of the oil phase.

It is believed that one of the major flow obstructions which results in declining productivity is the accumulation in the reservoir at or adjacent to the well of solid phase wax. This wax may be due to either an accumulation of mobile waxy solids with subsequent plugging or narrowing of the pore throats in the reservoir rock or precipitation of solid wax due to temperature, pressure or composition changes in the hydrocarbons being recovered. Such changes might occur at any point between the reservoir and the storage tanks on the surface. Moreover, because the wax is associated with the oil phase, any accumulation of solid phase wax in the well tends to selectively damage the mobility of the oil phase and thus reduce the production of oil from the well.

Many methods have been developed and proposed to stimulate the production of oil in wells to increase profitability and extend the ultimate recovery. One common and relatively successful technique is referred to as hydraulic fracture. In this technique, a high pressure fluid is used to fracture the rock formation, thus creating a channel which penetrates into the reservoir. The fracture is subsequently propped open using a granular material, such as sand. The fracture bypasses hydraulic restrictions to the inflow of oil into the well by creating a new open channel and also by exposing a large surface area of the reservoir rock to the channel, thereby greatly increasing productivity of the formation surrounding the bottom of the well. However, this technique is subject to failure if the proppant is not successfully carried into the new fractures made in rock formation. Further, it can be difficult to control the fracturing process and if the fracture accidentally is extended beyond the oil zone into a gas or water zone, then the well may become uneconomic to operate.

Hydraulic fracturing can temporarily improve the productivity of wells which have a productivity decline due to an accumulation of solid wax. However, such technique does not remove the existing wax damage or change the basic wax damage mechanism; it merely bypasses existing wax damage. Thus, productivity of a fractured well will often decline at a high rate due to the accumulation of wax damage in the fracture channel. Subsequent refracturing of the reservoir may provide an improvement in productivity, but again productivity will decline over time. Subsequent refracturing thereafter typically does not provide sufficient productivity increases to be economic. Such fracturing may thus provide a short-term method of increasing production from a well, but because it does not address the wax accumulation problem, the problem usually re-asserts itself, resulting eventually in a loss of effectiveness for the fracturing method.

Other treatments to stimulate wells include perforating the casing of the well with shaped charges to provide channels or perforation tunnels through which the fluids can flow. Again this technique provides a short term improvement which may bypass, but does not remove, accumulations of wax, nor, prevent the further accumulation of wax.

Matrix acidization, in which an acid is pumped into a reservoir to dissolve formation rock and precipitated scales can also stimulate production in wells. However, for wells having solid wax damage, matrix acidization may not work effectively, as solid wax is insoluble in acid. Because acidization is inherently prone to create channels along the path of "least resistance", the acid often bypasses the low permeability wax damaged oil zone and instead penetrates directly into a water zone at the bottom of the reservoir. Thus wax deposits can limit the success of acidization stimulation, even preventing effective removal of any dissolvable rock or precipitation which are wax coated.

Another technique for stimulating production is thermal stimulation. In the case of thermal stimulation, oil, water or steam heated above grade may be pumped to the bottom of the well to try to stimulate production from the recovery area. However, it has been found very difficult to transfer the heat by steam, water or oil to the bottom of the well by reason of the thermal losses which take place as the hot medium is being transported down the well bore. (Society of Petroleum Engineers, Paper No. CIM/SPE 90-57 OPTIMIZING HOT OILING/WATERING JOBS TO MINIMIZE FORMATION DAMAGE by John Nenniger and Gina Nenniger of Nenniger Engineering Inc.)

For example, in the "hot oiling" technique, crude oil, solvent or water is heated above grade to a typical temperature of 100°-125° C. and then pumped into the well. Usually the heated fluid is pumped into the annulus between the tubing and the casing. Depending on the particular situation, some fluid will accumulate in the annulus, some fluid will flow into the reservoir, and some fluid will flow back up the tubing and out of the well. Heat from the "hot oil" is lost through the casing to the rock surrounding the well. Heat is also lost in countercurrent heat exchange with the fluid which circulates upwards out of the tubing. Temperature measurements at the bottom of the well show that the bottom hole temperature drops during the treatment and excessive volumes of hot fluid do not significantly raise the bottom hole temperature. Typically, the heated fluid will lose its excess temperature in the top 300-400 m section of the well due to heat losses to the casing and the countercurrent heat exchange described above. Due to the geothermal gradient, by the time the "hot fluid" reaches the production zone at bottom of the well, it is likely cooler than the casing and thus actually absorbs heat from the casing and the rock surrounding the well. Thus for most applications (for wells deeper than 300 m), the "hot fluid" arrives at the bottom of the well at a temperature below the reservoir temperature. Because the bottom hole temperature decreases during treatment, waxy solids are likely to precipitate from the crude oil and be filtered out in the pores of the reservoir in the recovery zone as the fluid flows into the recovery zone. Thus, although the "hot oil" technique removes the wax deposits near the wellhead, it often causes an accumulation of the waxy solids in the perforation tunnels and reservoir surrounding the well. Thus, the application of heat to the well by pumping "hot oil" into the well through the annulus is inadequate to remove waxy deposits in the formation and in fact usually leads to even greater formation damage. The hot watering technique experiences comparable heat losses and causes additional formation damage (e.g., by increasing the water saturation around the well, precipitation of inorganic scales, etc.), so hot watering is not an effective technique for removing formation damage due to wax.

Another method of thermal stimulation is disclosed in Canadian Patent 1,182,392, dated Feb. 12, 1985 in the name of Richardson et al. (see also U.S. Pat. No. 4,219,083) which discloses a nitrogen gas generation system to produce a heat spike in a water-based brine solution. In this method, the salt water solution undergoes a chemical reaction to release heat, together with nitrogen gas, as it is being delivered down the well, thereby avoiding some of the heat losses associated with transporting a hot fluid down the well as discussed above for the "hot oil" technique; the salt water solution only becomes hot when it is some way down the well. The salt water solution may then be shut in for a period of about 24 hours to allow the heat carried by the solution to melt wax located in the recovery zone. The disclosure notes that wax solvents may be flushed down the well prior to or after the injection of the heat-producing salt water solution.

However, there are several inherent disadvantages to the method disclosed in U.S. Pat. No. 1,182,392. Firstly, the wax is not soluble in the salt water solution, so even if the heat developed is sufficient to melt the solid wax deposits, two separate liquid phases will occur (i.e. a liquid hydrocarbon phase including liquid wax and crude oil and a liquid aqueous phase including formation water and salt water solution). If the water saturation is high in order to get a significant temperature rise then the relative permeability of the liquid hydrocarbon phase will be very low as compared to the water and the mobility of the hydrocarbon phase containing the wax will be obstructed. Thus, the water-based fluid cannot effectively carry the melted wax out of the reservoir. Even if solvent is present in the formation, either by means of a pre-treatment flush, or a post-treatment flush, the salt water solution and nitrogen gas produced by the reaction will together greatly impede the solvent from coming into contact with any such melted wax, greatly reducing the treatment's effectiveness.

Past studies have shown the effect of water saturation on relative permeability (B. C. Craft and M. F. Hawkins Applied Reservoir Engineering, Prentice-Hall, 1959). The relative permeability curves (i.e. data) for a particular reservoir allow the flow rate of oil or water through rock pores to be calculated as a function of fluid saturation and pressure drop. For example, on page 357 FIG. 7.1 shows that if the water saturation exceeds 0.85, then the remaining 0.15 volume fraction of oil will not be mobile. FIG. 7.2 of this reference also shows that an increase in the water saturation of just 0.35 decreases the relative permeability (or mobility) of the oil phase by 100 fold. Thus, if salt water solution is squeezed into the formation, the saturation of the water is increased and the relative permeability of the oil/melted wax phase will be greatly reduced. If the water saturated formation is subsequently contacted with a solvent, the solvent will tend to channel due to the relationship between relative permeability and fluid saturation described above. Thus, the solvent cannot effectively contact or mobilize the melted wax. Thus, contacting the formation with an aqueous based heating fluid to be followed by a solvent is unlikely to effectively remove the wax from the pores of the reservoir rock. Furthermore, water can be damaging to some reservoirs as it can cause clay swelling or fines mobilization.

What is desired therefore is a method for removing the accumulations of solid wax from the fluid passageways which comprise the well to remove impediments to the flow of liquid hydrocarbons being produced from the reservoir to enable increased liquid hydrocarbon production rates. Preferably, such a method would be inexpensive to use and would be capable of being used without a great deal of inconvenience or alteration to the well itself. Preferably, the treatment would physically remove any solid wax, and would be effective every time it was used. The method also would preferably not introduce any water based liquids into the formation to avoid reducing relative permeability, and hence mobility of the liquid hydrocarbons. Such method would also avoid heat losses associated with transporting a fluid from a cold location (i.e., the wellhead) to a warmer zone (i.e., the downhole production zone), which could lead to a decrease in the bottomhole temperature and cause wax precipitation and accumulation, resulting in formation damage.

SUMMARY OF THE INVENTION

According to one aspect of the present invention, there is provided a well treating process to remove solid wax from fluid passageways between the well and a surrounding underground reservoir, said process comprising:

lowering an electric heater into the well to a position adjacent to the wax to be treated, selecting a solvent which is generally miscible with melted wax, pumping said solvent down the well at ambient temperature, energizing said heater to release heat, flowing said solvent past said energized heater, heating said solvent sufficiently to mobilize solid wax species having molecular weights of at least $C_{30}H_{62}$, displacing said heated solvent into fluid passageways between the well and a surrounding underground reservoir, contacting said heated solvent with the solid wax to be removed to mobilize said wax without reducing the relative permeability of the wax/solvent phase, removing said heater from said well and removing the mobilized wax from said fluid passageways, whereby enough of said species of obstructing solid wax are removed from said fluid passageways to increase the permeability of said fluid passageways between said underground formation and said well to said crude oil.

According to another aspect of the present invention there is disclosed a method of stimulating an oil well by treating solid wax, said method comprising:

lowering an electric heater into the well to a depth of more than 300 meters to a position adjacent to the wax to be treated, seating said heater in the well, selecting a solvent which is generally miscible with melted wax, pumping said solvent down the well at ambient temperature, energizing said heater to release heat, flowing said solvent past said energized heater, heating said solvent sufficiently to mobilize solid wax species located in the fluid passageways in the formation, displacing said heated solvent into fluid passageways between the well and a surrounding underground reservoir, contacting said heated solvent with the solid wax to be removed to mobilize said wax without reducing the relative permeability of the wax/solvent phase, and removing said heater from said well, and removing the mobilized wax from said fluid passageways, whereby enough of said species of obstructing solid wax are removed from said fluid passageways to increase the permeability of said fluid passageways between said underground formation and said well to said crude oil.

According to another aspect of the present invention there is disclosed an electrical heater for heating fluids, comprising:

a means for attaching the heater to a source of electrical power; and a resistive electric heating element means, said heating element means having a hydraulic pressure drop there across of 20 mPa or less for a flowrate of 1 $m^3$/day;

a heat transfer area greater than 10 $m^2$ per 1 $m^3$ of heater; and an electrical resistance greater than or equal to 1 ohm and less than or equal to 200 ohms.

BRIEF DESCRIPTION OF THE DRAWINGS

Reference will hereinafter be made by way of example only to the attached figures which illustrate a preferred embodiment of the present invention and in which.

DETAILED DESCRIPTION OF THE DRAWINGS

Up until the present, the composition and solubility of wax has not been well understood. Typically, wax has been treated as a single compound and its solubility has been assumed to be a weak function of temperature. However, the normal paraffins (N-paraffins) which precipitate to form wax deposits in underground hydrocarbon reservoirs include species from $C_{20}H_{42}$ to $C_{90}H_{182}$ and higher. As mentioned earlier, the wax deposits are associated with the oil or condensate in the reservoir and typically contain between 30 and 90 percent of the associated liquid hydrocarbon. When a wax deposit precipitates from an oil or condensate, the composition of a particular wax deposit appears to depend both on the amount of each of the N-paraffins dissolved in the liquid hydrocarbon and the solubility of each of the N-paraffins in such liquid hydrocarbon. The solubility of a particular N-paraffin in a particular crude or condensate is related to the carbon number of the paraffin and the temperature and the solubility parameter of the liquid hydrocarbon. Thus, as the oil temperature changes, the composition of the wax deposits changes. The solid wax which precipitates and accumulates downhole at high temperature tends to include higher molecular weight paraffins and have higher melting points. (see OPTIMIZING HOT OILING/WATERING JOBS TO MINIMIZE FORMATION DAMAGE by John Nenniger and Gina Nenniger of Nenniger Engineering Inc.) Moreover, because these wax deposits occur naturally at elevated temperatures in crude oils and condensates, it is obvious that these deposits contain highly insoluble paraffins.

Figure 1:
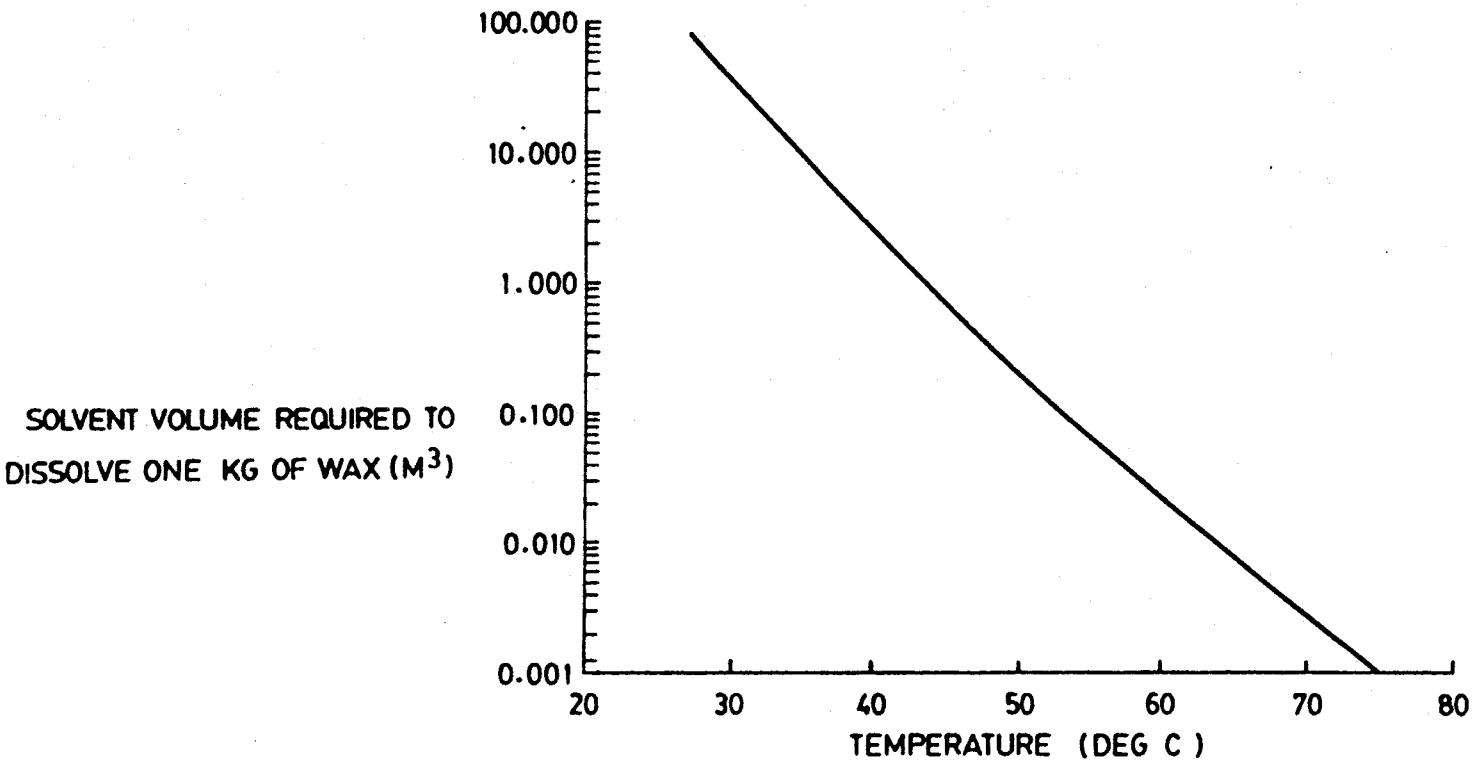
FIG. 1 is a graph depicting the relationship between solvent volume requirement to dissolve a downhole wax deposit (in $m^3$ solvent/kg of wax) against treatment temperature in degrees Celsius.

One of the techniques which has been used by industry to treat wells to remove wax deposits is to employ solvents; a solvent is pumped or "squeezed" into the formation to dissolve the wax. When the well is put back into production the solvent carrying the dissolved wax is then pumped out of the well. Although this technique has been frequently used, the composition of the wax deposit has generally not been known, and so the solubility of the reservoir wax in the solvent is not known either. FIG. 1 shows a solubility curve of the volume of a typical solvent required to dissolve 1 kilogram of a typical wax deposit as a function of temperature. For a reservoir temperature of 40° C., more than 2 $m^3$ of solvent are required to dissolve just 1 kilogram of wax. In general, excessive volumes of solvent are required to remove wax damage at reservoir temperature.

However, FIG. 1 also shows that if the solvent can be heated to 70° C., then only two liters of solvent are required per kg of wax deposit. Although different solvents are slightly more or less effective, the effect of temperature (i.e. the slope of the curve in FIG. 1) is similar for many different solvents. Thus, one surprising result is that the application temperature of the solvent is so critical in determining the effectiveness and usefulness of any such solvent treatment. However, what remains is how to effectively heat the solvent to achieve the desired effective and useful result, namely, the mobilization and removal of a significant amount of the accumulated wax deposits. In this context it will be appreciated that significant means sufficient removal of wax to measurably increase production rates or flow rates through the treated area. In this context, to heat the solvent, means that the solvent has had its temperature raised above the naturally occurring temperature of the reservoir.

According to the present invention there is disclosed an apparatus and a method in which a solvent is heated directly adjacent to the treatment area. Several different sources of energy could be used to raise the temperature of the solvent at the bottom of the well (e.g., exothermic chemical reaction, electrical heating, radioactive decay). However, electrical heating is preferable due to safety, control, reliability and cost considerations. The use of electrical energy avoids certain problems inherent in the heating the solvent via chemical reaction. Firstly, it avoids the transportation of hazardous chemicals, such as oxidizers and fuels. Secondly, it avoids the difficulties associated with initiating ignition and controlling the chemical reaction, such as the rate of the chemical reaction and the hazards associated with any incomplete reactions, such as residual explosive mixtures of gas or corrosion. Electrical heating also avoids formation damage due to the oxidation of any aqueous species present. An example of this problem would be the oxidation of $Fe^{++}$ to $Fe^{+++}$ and a subsequent precipitation of $Fe(OH)_3$. Lastly, any partial oxidation of hydrocarbons in a chemical reaction heating system can produce gums, tars or asphaltene-like material which could plug the pores of the formation and create even worse formation damage than the solidified wax.

The generation of heat by dissipation of electrical power can occur by several means. For example, inductive, resistive, dielectric and microwave technologies can be used to generate heat from electrical power. Of these, a resistive heater described herein is preferred due to its compact size, simplicity, reliability and ease of control.

Figure 2:
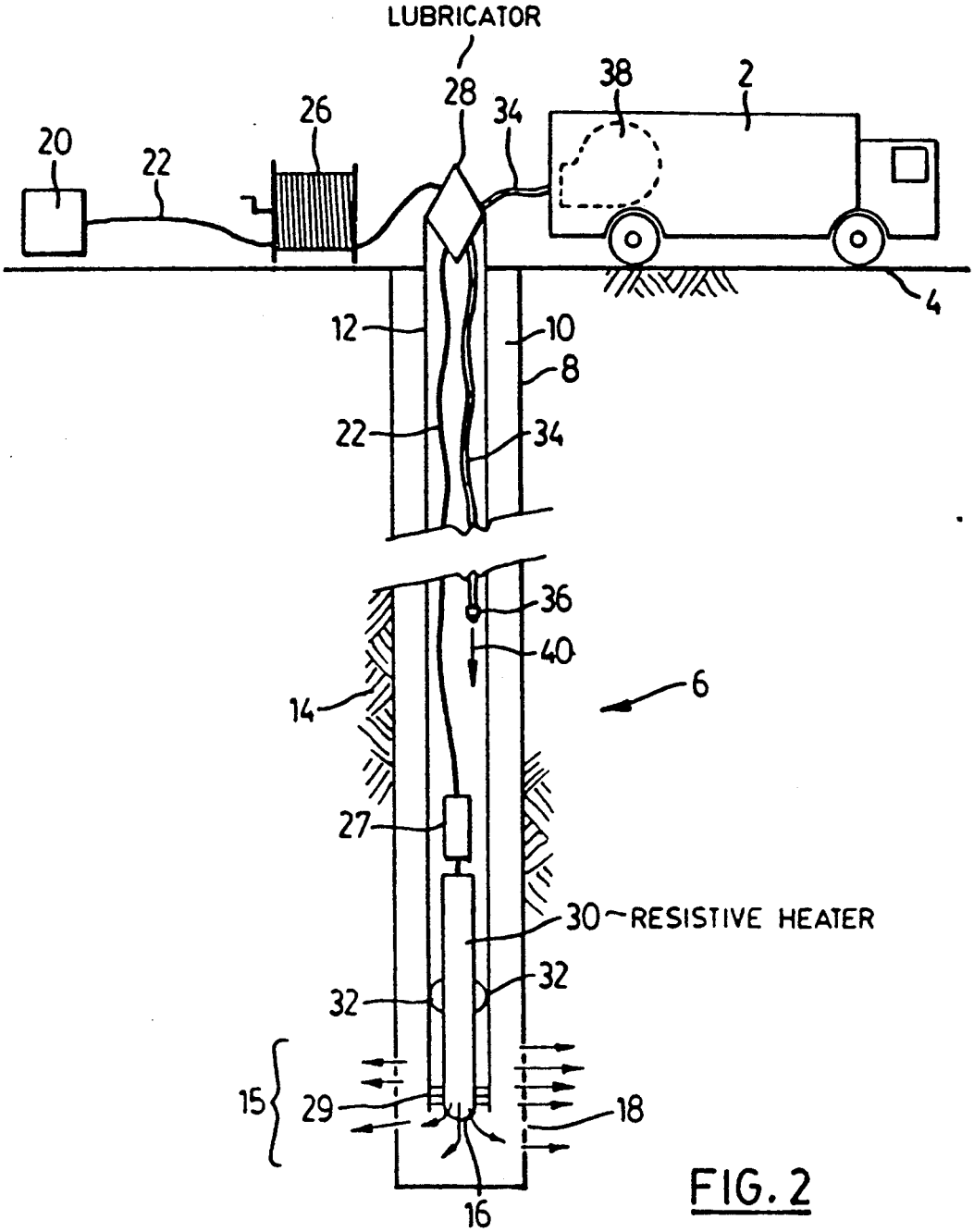
FIG. 2 is a preferred embodiment of the invention.

FIG. 2 shows a schematic diagram of a preferred embodiment of the invention. The equipment shown consists of a number of components. A truck 2 is shown resting on a surface grade 4. An oil well is shown schematically and oversized generally as 6 with an outer casing 8 forming an annulus 10 around a tubing string 12. The tubing string 12 penetrates through a formation 14 to a recovery zone 15.

At the bottom of the tubing string 12 is an opening 16 which allows fluid communication between the tubing string 12 and the annulus 10. Numerous perforations 18 are provided in the outer casing 8 at the recovery zone 15. The perforations 18 allow fluid communication between the annulus 10 and the recovery zone of the formation 15.

Also shown above grade are an electrical generator indicated schematically at box 20 which has power outlet cord comprising electrical conductor 22. The generator 20 is preferably of a portable diesel electric type, although in situations where the well 6 has an adequate supply of electrical power, the generator 20 may be replaced by a conventional electrical power grid hook-up, along with appropriate transformers, rectifiers and controllers. Dependent on the application, it may be advantageous to convert the alternating current (AC) power to direct current (DC) as more power can be carried by a given conductor 22 in DC operation and inductive coupling between the conductor 22 and the tubing 12 is also avoided.

The next component is a wire line assembly, which includes a winch 26 which raises and lowers the conductor 22 within the tubing 12. The winch 26 is operated by a gas or electric motor or the like. The insulated conductor 22 passes around the winch 26 and through a lubricator 28. The lubricator 28 facilitates the passage of the insulated conductor 22 into and out of the wellhead of the tubing 12. The lubricator 28 is also adapted to provide a pressure seal around the cables as required. The winch 26, lubricator 28 and electrical generator 20 will be familiar to those skilled in the art. Consequently they are not described in any further detail herein.

The electrical conductors 22 are preferably in the form of insulated electrical cables. Where the depth of the well is such that the strength of insulated cable is inadequate, such cables could be replaced or strapped onto the sucker rods (not shown) which are usually used in the well to raise and lower the pump. If the sucker rods were used as a conductor, they would have to be electrically isolated to prevent contact with the production tubing. The electrical power would then be transmitted downhole through the sucker rods. A further alternative would be to use the tubing 12 itself as a part of the electrical circuit as described in more detail below. However, this alternative would also require appropriate electrical isolation.

Figure 3:
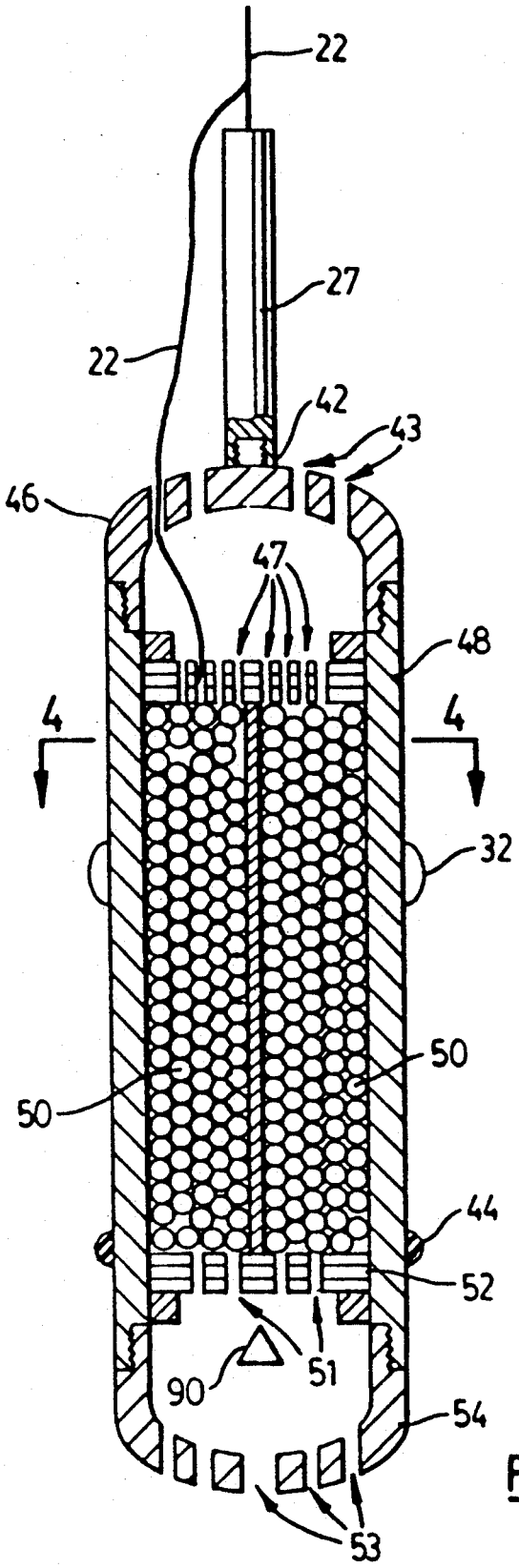
FIG. 3 is a close up view of a component of the preferred embodiment of FIG. 2.

At the bottom end of conductor 22 is shown a set of jars 27 and a resistive heater 30 which are shown in more detail in FIG. 3. The jars 27 are slidably connected to the conductor 22 and can be used to supply a sudden impulse (jerk) to the heater 30 and thus free the same in the event it becomes stuck downhole. A contactor 32 is also shown which is utilized when the tubing 12 is used as a conductor to return the current back to the wellhead and to the generator 20 thereby completing the electrical circuit. Thus, the contactor 32 may be required to provide a good electrical contact between the tubing 12 and the heater 30. Alternatively, the conductor 22 could allow the current to return to the generator 20 via a return insulated electrical power line.

Figure 4:
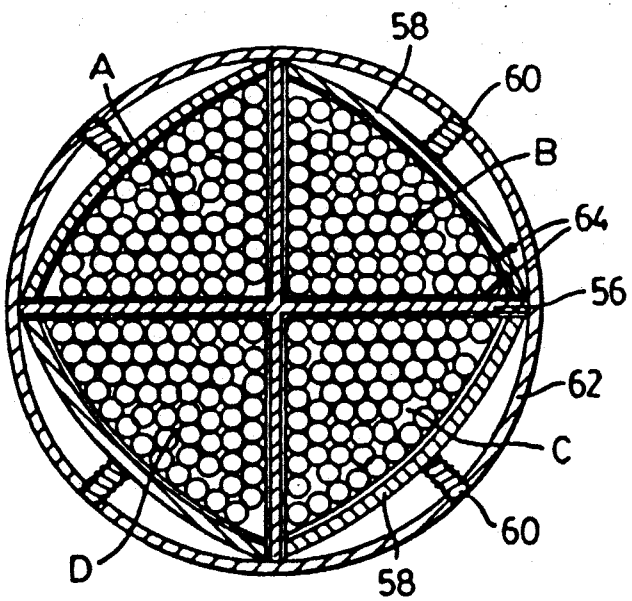
FIG. 4 is a cross-sectional view along line 4—4 of FIG. 3.

The internal structure of the resistive heater 30 is shown schematically in FIGS. 3 and 4. The heater 30 is attached to the jars 27 by a coupling 42. The heater 30 has a slightly enlarged circumference 44 to seal against the pump seating nipple at the bottom of the tubing (shown in FIG. 2 as 29) to prevent solvent from bypassing around the outside of the heater 30. The heater 30 has fluid passageways or holes 43 in a threaded endcap 46 at the top to allow solvent to flow into the heater body 30. The solvent then flows through holes 47 in an upper distributor 48, through a packed bed 50 in a manner as hereinafter described, through holes 51 in a lower distributor 52 and out of holes 53 in a threaded endcap 54 at the bottom of the heater 30.

FIG. 4 shows the heater 30 in cross-section through line 5—5 of FIG. 3. A "+" channel member 56 separates the packed bed 50 into 4 channel segments labelled A, B, C and D. Also shown are inner liners 58, which may be compressed by set screws 60 threaded through an outer heater shell 62. The set screws 60 may be used to compress the packed bed 50. Such compression facilitates electrical contact between adjacent packing elements as described in more detail below. The set screws 60 are located at regular intervals along the length of the heater.

Figure 5:
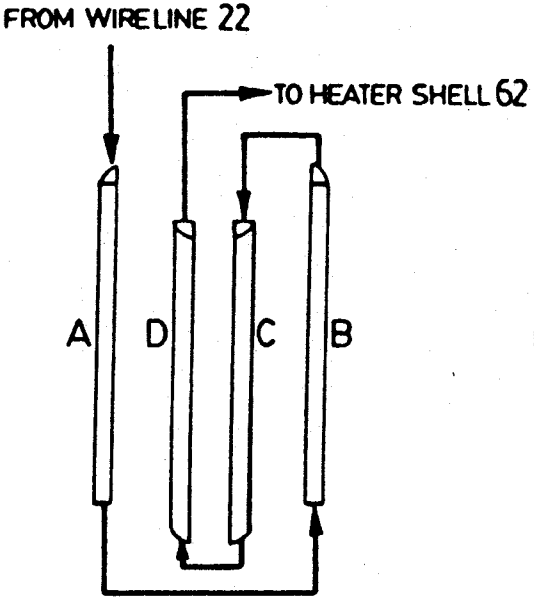
FIG. 5 is schematic of a part of a preferred circuit.

The electrical circuit through the packed bed 50 is shown schematically in FIG. 5. To prevent electrical short circuits the packed bed 50 and distributors 48 and 52 are electrically isolated from the "+" channel 56 and the inner liner 58 by an insulating coating material 64, such as a rubber, plastic or plasma sprayed ceramic. The upper distributor of channel segment A is connected to the power input from the conductor 22. The current then flows to the bottom of channel A of the packed bed 50 and then through a connector to the bottom of channel B. The electrical current then flows up channel B to the distributor at the top of channel B. The current then flows through a connector to the top of channel C. The electrical current then flows down channel C to the distributor at the bottom of channel C, through a connector to the bottom of channel D, up channel D to the distributor at the top of channel D. This distributor is in electrical contact to the header body 62 through a connector and the current is returned to the wellhead and the generator 20 through the tubing 12 or else a second conductor 22 to complete the electrical circuit.

Figure 6:
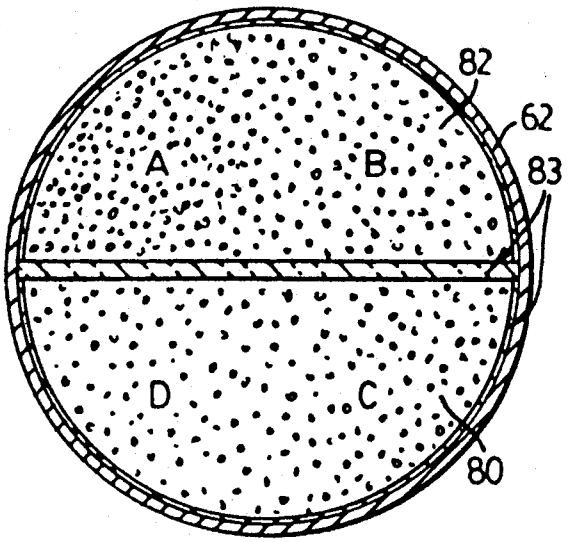
FIG. 6 is a detailed view of a component of FIG. 3.
Figure 7:
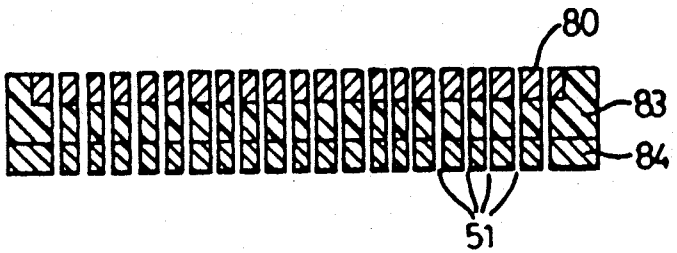
FIG. 7 is a cross-sectional view through the component of FIG. 6.

The lower distributor 52 is shown in more detail in FIGS. 6 and 7. FIG. 6 is a plan view of the lower distributor 52 showing a contact plate 80 which acts as an electrical connector between channel segments D and C. The contact plate 82 acts as an electrical connector between channel segments A and B. The contact plate 80 is isolated from the contact plate 82 by an insulating material 83. As shown in FIG. 7 the contact plate 80 is supported on the insulating material 83, which, in turn, is supported on a backing plate 84.

Figure 8:
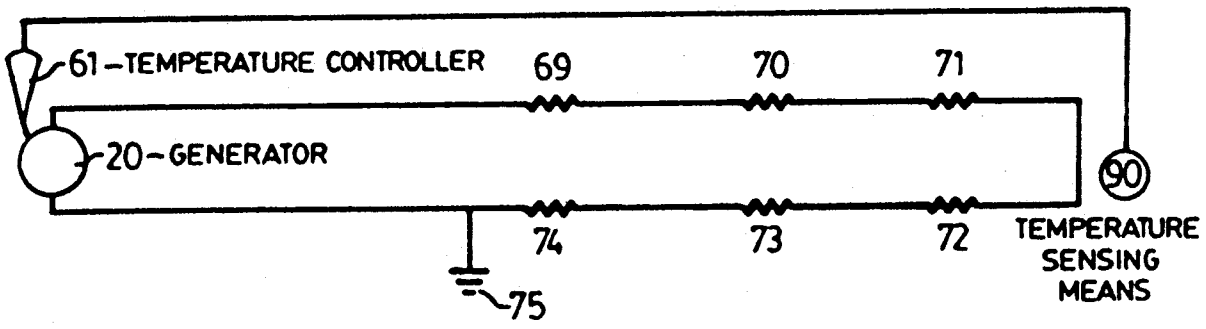
FIG. 8 is a circuit diagram of the preferred power circuit.

It will now be appreciated how the preferred electrical circuit of the present invention is configured. The electrical power is supplied by a variable voltage direct current (DC) power supply. DC power has several advantages over alternating current (AC), as mentioned before. The electric power is supplied by a direct current variable voltage 200 kW portable diesel electric power generator. The voltage is controlled either manually or automatically on the basis of a temperature measurement in the heater, and the maximum current is limited to 150 amps to avoid overheating conductor(s) 22. FIG. 8 shows the electrical circuit schematically, including the resistance 69 of conductor 22 on the downward limb of the circuit and resistances 70, 71, 72 and 73 caused by the packed bed channel segments A, B, C and D respectively. The resistance 74 of the return limb of the conductor 22 is also shown. A connection to ground is shown as 75. The temperature controller 61 is also shown connected between the generator 20 and a temperature sensing means such as a thermocouple or the like, shown as 90. It will be appreciated by those skilled in the art that the temperature sensor 90 can communicate with the temperature controller via several different means including signal wires bundled with conductor 22.

It will also be appreciated by those skilled in the art that, in certain instances there may be no tubing 12 within the casing 8. In such circumstances, the casing itself may be used as a return conductor in the same manner as described above for the tubing. In this case a packer could be used to provide a hydraulic seal between the casing and the heater to force the solvent through the heater 30 and into the recovery zone 15 of the reservoir.

The proper packing 50 for the present invention is quite important. In the preferred embodiment the packing 50 is comprised of a plurality of spherical balls. A preferred length for the heater 30 is 6 m. However, the length can vary depending on the amount of electrical power available and allowable pressure drop. A preferred outer diameter for the heater is that of the outer diameter of the pump, so the heater can then be raised and lowered onto the pump seating nipple and sealed to minimize fluid bypass around the outside of the heater. A preferred inner diameter for the heater 30 is 4.0 cm. However, the inside diameter can vary to suit the inner diameter of the tubing in a particular well.

In a typical oilwell, the tubing 12 has a 73 mm outer diameter (OD) and a 55 mm inner diameter (ID). In a preferred embodiment of the present invention, power is supplied by a 200 kW portable diesel electrical generator. The heat absorbed by the solvent as it passes through the heater is calculated according to the following equation:

$$Q=(T_{s,out}-T_{s,in})Cp_s\,Den_s\,F_s$$

where:

Q is the power dissipated in the heater (watts)

$T_{s,out}$ is the solvent temperature leaving the heater (C)

$T_{s,in}$ is the solvent temperature entering the heater (C)

$Cp_s$ is the heat capacity of the solvent (typically about 2000 J/kg C for liquid hydrocarbons)

$Den_s$ is the density of the solvent (typically about 900 kg/m$^3$ for a heavy reformate)

$F_s$ is the solvent flowrate in $m^3$/second

Thus, for a given power or heat transfer rate, higher solvent flowrates will result in lower heater outlet temperatures. Alternatively, a high heater outlet temperature can be obtained at a lower power by reducing the solvent flowrate. FIG. 1 shows that the required solvent volume decreases by three orders of magnitude for a 30° C. temperature rise. Thus a small temperature rise can provide a substantial benefit in terms of reducing solvent volume requirement. However, as the hot solvent is displaced into the pores in the reservoir formation or rock matrix, the hot solvent will cool down and the rock and immobile interstitial fluids will be heated. A large fraction of the cost (up to 50%) of the stimulation described herein is due to the cost of the solvent injected downhole. Thus, it is desirable to heat the solvent to the maximum feasible temperature which avoids solvent degradation and deleterious effects in the reservoir, such as mineral transformations. In this manner a maximum amount of heat or thermal energy is carried by a minimum volume of solvent.

When the above formula is applied to a heater 30 having an output power of 150 kW, and a desired temperature rise in the solvent of 200 degrees C yields a solvent flow rate of 0.42 liters per second or 25 liters per minute or 1.5 $m^3$ per hour. As discussed above, higher or lower temperatures and lower or higher flowrates will be appropriate for different solvents.

The heat generation rate within the resistive heater at steady state, is equal to the heat flux from the heater to the solvent as defined in the following formula:

$$Q = H_t A \, \delta T$$

Where:

$H_t$ is the heat transfer coefficient between the solvent and the heater ($W/m^2C$)

A is the surface area of resistive heater in contact with the solvent ($m^2$)

$\delta T$ is the local temperature difference between the solvent and the heater element (C)

Thus, for a desired solvent exit temperature from the heater of 230° C., (for an entrance temperature of 30° C. and a heat rise of 200° C. across the heater) the maximum temperature in the heater will occur in the heater element at the outlet and will be 230 + $\delta T$ degrees centigrade. Thus, a resistive heater design which has a large surface area (A) and a high heat transfer coefficient ($H_t$) will operate at a lower temperature for a given power and thus reduce solvent degradation.

The pressure drop for a flow of 0.42 liter/second can be estimated by the Burke-Plummer equation (R. B. Bird, W. E. Stewart, and E. N. Lightfoot, *Transport Phenomena*, John Wiley and Sons, pg 200, 1960)

$$\delta P/L = (1.75/D_{ball}) Den_s V_2 (1-\epsilon)/\epsilon^3$$

where:

$\delta P/L$ is the pressure drop per length (Pa/m)

$D_{ball}$ is the ball diameter (0.003175 m)

$Den_s$ is the fluid density (900 $kg/m^3$)

V is the solvent approach velocity (0.42 m/s)

$\epsilon$ is the void fraction ($\approx$0.4 for spheres)

Thus, for a ball size of 3.175 mm a bed length of 6 m, and flowrate of 1.5 $m^3$/hr the pressure drop across the heater is about 5 MPa (750 psi), which is well within the pressure limitations of the tubing and lubricator. The ball size of 3.175 mm was convenient; larger balls provide less pressure drop and less heat transfer surface for a given heater volume while small balls result in more pressure drop and more heat transfer surface for a given bed volume. A bed length of 6 meters is convenient however the length could vary from 1 m to 20 m depending on the particular application. The pressure drop of 5 MPa, for a flowrate of 1.5 $m^3$/hr is convenient however, any configuration with a pressure drop less than 20 mPa for a flowrate greater than 1 $m^3$/day is acceptable.

The electrical resistance of most metals is too low to achieve any significant heating without excessively long heating elements. However, in a packed bed configuration, a high electrical resistance arises due to the limited contact area between adjacent spherical balls. The resistance of the packed bed is sensitive to a number of factors, including the amount of compression on the bed, the surface preparation and finish of the balls, the ball size, the type of metal and the maximum power applied to the bed. It is preferred to use spherical packing elements because the resistance will not depend on the packing orientation and the sphere to sphere contact area (i.e. the resistance) will be quite uniform throughout the bed. The accepted resistivity of Carpenter stainless steel type 440C is reported to be $6\times10^{-7}$ $\Omega$m. The resistivity of a packed bed of 3.175 mm balls made from the 440C steel was measured at $1.6\times10^{-4}$ $\Omega m$ at 45 W/cc or more than two orders of magnitude higher. Thus, the resistance of a cylindrical packed bed 6 m long with an inner diameter of 4 cm is 0.76 $\Omega$. Therefore in a well 1000 meters deep, the resistance of both legs of the conductor 22 will be 2.0 $\Omega$ for #4 AWG copper or 1.33 $\Omega$ for #2 AWG copper is so large compared to the heater resistance that up to 70% of the power would be dissipated in the power transmission rather than in the heater. However, by dividing the bed into 4 segments and connecting the segments in series as discussed above, the heater 30 resistance is increased by more than an order of magnitude due to the reduced cross sectional area of each segment, as well as by the longer current path through the bed. In this manner the heater resistance is increased to 10 $\Omega$ and the power transmission losses are reduced to less than 17%. Although a 10 $\Omega$ heater resistance is convenient, a heater resistance as low as 1 $\Omega$ could be used in the present design. Higher heater resistances minimize the power transmission losses but require higher voltages. The maximum heater resistance (at 150 kW) should be less than 200 $\Omega$ due to the breakdown of the electrical insulation at high voltages.

From the foregoing it will be appreciated that the "+" channel configuration for the packed bed is not essential. For example, an alternative material for the spherical packing element could be used directly without the "+" channel, provided it provides a packed bed resistivity of $2\times10^{-3}$ $\Omega$m. Also, it will be appreciated that the equations set out herein can be manipulated to change any of the parameters, such as length, power, packing element size and the like, which could yield similar configurations.

An additional benefit of the packed bed configuration arises due to the multiple electrical contacts between balls in the bed. Thus, many parallel electrical paths occur within the packed bed due to the multiplicity of electrical contacts. Because there are so many alternate pathways for the current within a given channel segment, the packed bed heater is not prone to the burnout and catastrophic failure problem usually associated with electrical resistance heaters.

It has been observed that the above described heater configuration is self-regulating in that it appears to avoid excessive hot spot formation and catastrophic burn out within the preferred power range. The preferred configuration is a heater with uniform spherical conducting elements placed in a packed bed configuration. Thus each ball or conducting element is in contact with up to twelve other conducting elements depending on whether the conducting element is in the middle of the bed or at a perimeter. The contact point between spheres is very small in cross-sectional area due to the curvature of the surface of the balls. Thus, the current flowing through the bed meets with significant electrical resistance as it passes through each contact point. This resistance, in turn, produces heat at each contact point.

When a prototype heater was tested it was observed that the bed resistance is a function of the power per unit volume. Thus, increases in power per unit volume tend to decrease absolute resistance.

It was also observed that the packed bed behaves as a homogeneous electrical resistor. For example, at 50W/cc, with various bed dimensions, the electrical resistance of the bed is inversely proportional to the cross-sectional area and directly proportional to length. This result demonstrates that the electrical current does not channel through the bed. This result is important because electrical channelling would create hot spots and lead to fluid degradation. Moreover, the bed is not prone to catastrophic burnout because of the multiplicity of current pathways.

It will be appreciated that the foregoing description relates to conducting elements which are uniform size spheres, preferably of stainless steel. However, other packed bed configurations, including 2 spheres of different sizes, conducting elements of different shapes, or including conducting elements of different materials of the same or different sizes or shapes may also be used. It is believed that the important point is to keep the bed in compression, the contact points small between adjacent elements, and to provide a plurality of alternate current pathways to allow the heater to approach an equilibrium which prevents local hot spot heating and the attendant burnout that may be associated therewith.

In the preferred method, the use of this heater configuration allows the solvent to be displaced through a self regulating heater which prevents catastrophic burnout of the heating element and avoids hot spot formation, and, additionally, prevents degradation of the solvent to be heated. This is important because solvent degradation could produce solid byproducts such as coke which could plug the fluid channels in both the heater bed and in the oil reservoir.

Thus for 150 kW of power dissipated in the heater, the required current will be 150A and the voltage required at the wellhead will be 1200V. The choice of 440C stainless was convenient in this application. However, many alternate materials can be substituted, including metals, alloys, ceramic composite materials, semiconductors, minerals and graphite With an alternative material it may not be necessary to divide the bed into sections to achieve a practical heater resistance.

The surface area of the heater element is calculated by multiplying the total number of balls in the bed by the surface area of a ball.

$$\text{Surface Area} = (Vol_{bed}(1-\epsilon)/Vol_{ball})\,\pi d_{ball}^2$$
$$= (1.5\,\pi\,L\,ID^2)(1-\epsilon)/d_{ball}$$
$$= 8.5\ \text{m}^2$$

The heat transfer coefficient is calculated using Eckert's correlation for packed beds pgs 411, 412 in Transport Phenomena.

$a = 1100\ \text{m}^2/\text{m}^3$
$Go = 300\ \text{kg/m}^2\text{s}$
$\mu = 0.001\ \text{kg/ms}$
$\Phi = 1$ for spheres
$Re = Go/(a\mu\Phi) = 272.$
but $j_H = 0.61\ Re^{-0.41}\Phi = 0.061$
k = thermal conductivity of solvent (0.12 W/m ° C.)
Therefore $H_t = 5{,}000\ \text{W/m}^2\ ^\circ\text{C.}$
Therefore $\delta T = Q/H_t A = 150{,}000/5000 \times 8.5 = 4^\circ$ C.
Therefore the maximum temperature = 230+4 = 234° C.

The heat transfer coefficient in the packed bed is about 10 times better than for other configurations such as heated tubes. In addition, the packed bed has a large surface area per unit volume (1100 $m^2/m^3$), so the heater is compact and has very high surface power rates (2 $W/cm^2$) with very small temperature gradients (4° C.) between the heater and the solvent. Heat transfer surface areas of 10 $m^2$ per $m^3$ of heater volume are a lower limit of practical application. Generally it is desirable to have as large a heat transfer area per unit heater volume as practical.

The average residence time of solvent in the heater (the void volume divided by the flowrate) is 7 seconds. Thus the solvent heats up at a rate of 30 ° C./second as it passes through the heater. The low heater element temperature and the short contact times in the packed bed are both highly desirable features to avoid solvent degradation.

A small scale heater was built and tested. A resistivity of $1.6 \times 10^{-4}\ \Omega$m, was measured at 45 W/cc with AC power with 3.175 mm Carpenter 440C stainless balls at 20 ° C. This data indicates that a heater with the preferred configuration described herein could possibly operate up to 340 kW with a resistance of 12 Ω. This result is more than adequate for the preferred design, as slightly higher resistivities require higher voltages and less amperage. Thus, either smaller conductors 22 can be used or alternatively less power is lost in transmission.

It may now be appreciated how the method of the present invention may be employed. Prior to employing the preferred method the pump needs to be removed from the well 6. This is usually accomplished by "killing" the well with a fluid to prevent uncontrolled production of hydrocarbons while the well 6 is open to the atmosphere to remove the pump. It is preferable that the well be killed with an oil or solvent rather than water. However, if the well has been killed with water, then the water should be displaced out of the well by circulating oil or solvent down the annulus and back up the tubing. Once the water in the well has been displaced, a mutual solvent is preferably pumped into the tubing to further displace water away from the recovery zone surrounding the wellbore. A mutual solvent is a liquid which is partially soluble in both oil and water. Such a liquid is EGMBE (ethylene glycol monobutyl ether) or isopropanol/toluene. Such a mutual solvent would have several beneficial effects, as will be now appreciated. For example, the mutual solvent will increase the permeability of the solvent or oil by increasing the degree of saturation of the oil phase relative to the water phase. This mutual solvent will assist in bringing subsequent solvent applications into greater contact with the wax to be treated. By increasing the degree of saturation of the solvent, such a pretreatment will also facilitate the removal or displacement of the oil/solvent/wax phase from the formation surrounding the well.

The next step in the preferred method is for the electrical cable 22 with the jars 27, resistive heater 30, and contactor assembly 32, to be lowered to the appropriate depth within the tubing 12 through the lubricator 28. The solvent truck 2 then begins to pump solvent into the well 6 at the desired rate by means of a pump 38. As shown in FIG. 2, a hose 34 passes through the lubricator 28 down into the tubing 12 and has a nozzle 36. It will be appreciated by those skilled in the art that the nozzle 36 may be placed at any desired location within the tubing 12 and in fact, it may be sufficient merely to connect the nozzle 36 to an appropriate orifice on the wellhead and simply pump the solvent directly down through the tubing 12. Alternatively it may be desirable to connect the hose 34 directly to the heater (e.g., if the tubing is completely blocked with wax) in order to pump solvent directly to the heater. The solvent then makes its way down the tube as indicated by arrow 40 where it encounters the resistive heater 30. The generator 20 is started and electrical power is then transmitted through electrical cable 22 and through the tubing 12 to the heater 30. As the solvent is pumped down the tubing 12, with the valve on the annulus 10 closed, it passes through the heater 30, out the bottom orifice 16 of the tubing 12, through the perforations 18, in the casing 8 and into the recovery zone of the formation 15. In some cases it may be necessary to seal the annulus 10 to prevent the solvent from circulating up. In addition it may be desirable to use a packer, gelled hydrocarbons or non condensible gas to reduce heat losses due to convection in the annulus.

When the solvent is almost all completely displaced into the formation, the power is switched off. The conductor 22 and the heater 30 and hose 34, may then be removed from the well and the well may be put back into production. Alternatively, the hot solvent may be left to soak for a period of time before the well is put back into production.

In this context solvent refers to any fluid which has an external phase miscible in all proportions with wax at the melting point of the wax. Preferred solvents include crude oil and condensate, refinery distillate and reformate cuts (naphthenic, paraffinic, or aromatic hydrocarbons), toluene, xylene, diesel, gasoline, naptha, mineral oils, chlorinated hydrocarbons, carbon disulphide and the like. Miscibility is desirable to avoid relative permeability problems as described above. In the case where the solvent could be considered as an emulsion (e.g., a crude oil containing a small proportion of produced water), then the continuous phase of the solvent is miscible with the melted wax at the treatment temperature and pressure.

The flow rate of the solvent is determined by the pump capacity and pressure drop across the heater, as well as the desired solvent temperature rise for the available power supply. The depth of heat penetration into the formation will depend upon the total volume of solvent injected and the solvent temperature. The optimum distance that the heated solvent is injected into the reservoir will depend on the amount and depth of wax damage, as well as the porosity of the rock and will vary from well to well.

The volume of solvent used according to the present invention will also vary, depending upon the formation being treated. For example, if the wax deposits or formation damage are present at a large distance away from the wellbore, then a larger volume of hot solvent will be necessary. The treatment typically will require 1-30 $m^3$ of solvent per meter of formation being treated. The removal of wax accumulations from the formation, or even from the wellbore rods and tubing will enhance productivity of the well. Such wax removal will also enhance other types of well treatment activities, increasing the effectiveness of a fracture treatment, an acid stimulation and the like. It will also be appreciated by those skilled in the art that additives could be included in the solvent to enhance various properties. For example, these additives can include a number of chemicals, such as surfactants, dispersants, viscosity control additives, natural solvents, crystal modifiers, inhibitors and the like.

As can be appreciated from FIG. 1, increasing the temperature of the solvent 30° C. increases the wax carrying capacity of the solvent by 1000 fold. This temperature rise in turn increases the effectiveness of the well treatment and reduces the volume of liquid required. If less liquid is required, then less time is required to pump the solvent carrying the dissolved wax out of the well, the wax is less likely to cool down and reprecipitate in the formation rock and the oil/gas/condensate production and profitability can resume more quickly. By using a miscible heated and effective solvent, the removal of wax from pores and micropores at the reservoir or production level can be accomplished. In the reservoir, an additional benefit of the hot solvent is due to minimizing the gas and water saturations and thus maintaining the highest feasible mobility or relative permeability for the oil/solvent/wax phase.

The solvent is pumped or flows through the resistive heating apparatus and is heated. For convenience and improved reliability, there may be temperature, pressure and flow monitoring instrumentation and control devices also included in the heater.

It will be appreciated that this invention teaches the removal of wax deposits from oil, gas and condensate reservoirs and production systems by the use of a wax solvent which has been heated to greatly reduce the volume of solvent required to dissolve the solid wax. The preferred method contacts the wax with a heated solvent without raising the saturation of the water phase and reducing the mobility of the oil/solvent/wax phase. The solvent is heated near the wax to be treated to avoid the premature loss of heat (or solvent fluid temperature) as described for hot oiling.

It can now be appreciated more clearly what the failings of the prior water-based heat-producing methods are. In fact, it is not so important to apply heat to the wax to be removed, as was previously taught. It is much more important and effective to have a treatment which heats the solvent, and then contacts the hot solvent with the solid phase wax to mobilize the wax and facilitate the removal of the dissolved/melted wax from the formation before the solid phase reasserts itself. The removal of the liquid hydrocarbon phase (i.e., the oil/solvent/wax phase) from the rock will be severely obstructed by the presence of the water and the gas phases due to the relative permeability effects in multiphase (i.e., water, hydrocarbon liquid, gas) flow. In other words, introducing water into a formation has the very undesirable result of preventing the oil/solvent/wax phase from being mobile through the formation. The higher the water content, the lower the permeability of the oil/solvent/wax phase. This effect is eliminated in the present invention because no water is used.

It will be appreciated by those skilled in the art that the foregoing description is by way of example only, and that many variations are possible within the broad scope of the claims. Some variations have been discussed above and others will be apparent to those skilled in the art. Further, it will be appreciated that while reference has been made to treatment of the recovery zone surrounding a well, the method and apparatus according to the present invention will be equally useful in removing wax damage in production systems, including the tubing, the rods, the annulus, the wellhead, flow lines, pipelines, storage tanks and the like. In short, the heated liquid solvent can easily reach any wax deposits in any fluid based treatment system. It will also be appreciated that this invention may be usefully used to treat high water cut wells, or wells with water coning problems, which have selective damage to the oil saturated zone due to wax. It will also be appreciated that this invention may be usefully used to treat high gas cut wells, or wells with excessive gas production, which have selective damage to the oil saturated zone due to wax. In both water coning and high GOR (Gas Oil Ratio) problem wells, increasing the permeability of the oil zone by removing wax deposits can increase the production rate of oil and increase the ultimate recovery of the oil from the reservoir.

I claim:

1. A method of stimulating an oil well by treating solid wax, said method comprising:
- lowering an electric heater into the well to a position adjacent to the wax to be treated,
- selecting a solvent which is generally miscible with melted wax,
- pumping said solvent down the well at ambient temperature,
- energizing said heater to release heat,
- flowing said solvent past said energized heater,
- heating said solvent sufficiently to mobilize solid wax species having molecular weights of at least $C_{30}H_{62}$,
- displacing said heated solvent into fluid passageways between the well and a surrounding underground reservoir,
- contacting said heated solvent with the solid wax to be removed to mobilize said wax without reducing the relative permeability of the wax/solvent phase,
- removing said heater from said well and removing the mobilized wax from said fluid passageways,
- whereby enough of said species of obstructing solid wax are removed from said fluid passageways to increase the permeability of said fluid passageways between said underground formation and said well to said crude oil.

2. A method as claimed in claim 1 wherein said step of flowing said solvent past said heater increases the solvent temperature sufficiently to reduce the volume of solvent required to dissolve the solid wax to be treated to at least 1/10 of the volume of the same solvent required to dissolve the same solid wax at the temperature naturally occurring in the treatment area.

3. A method as claimed in claim 1 or 2 wherein said step of flowing said solvent past said heater increases the solvent temperature by at least 10 degrees celsius above the temperature naturally occurring in the treatment area but below a temperature at which unacceptable solvent degradation occurs.

4. A method of stimulating an oil well as claimed in claim 1 which further comprises a pretreatment step of introducing a mutual solvent, which is partially soluble in both water and the hydrocarbons to be recovered, into the treatment area prior to introducing said heated solvent to displace water from the treatment area, to enhance contact between the heated solvent and the wax deposits.

5. A method of stimulating an oil well as claimed in claim 1 wherein said well comprises a casing and a tubing and said method further includes placing means for preventing convection circulation within an annulus between said tubing and said casing.

6. A method of stimulating an oil well as claimed in claim 1 or 2 wherein said step of heating solvent is accomplished by passing said solvent by an electrically powered heater placed adjacent to the treatment area.

7. A method of stimulating an oil well as claimed in claims 1 or 2 wherein said step of heating said solvent is accomplished by passing said solvent by an electrically powered resistance heater placed adjacent to the treatment area.

8. A method of stimulating an oil well by treating solid wax, said method comprising:
- lowering an electric heater into the well to a depth of more than 300 meters to a position adjacent to the wax to be treated,
- seating said heater in the well,
- selecting a solvent which is generally miscible with melted wax, pumping said solvent down the well at ambient temperature, energizing said heater to release heat,
- flowing said solvent past said energized heater,
- heating said solvent sufficiently to mobilize solid wax species located in the fluid passageways in the formation,
- displacing said heated solvent into fluid passageways between the well and a surrounding underground reservoir,
- contacting said heated solvent with the solid wax to be removed to mobilize said wax without reducing the relative permeability of the wax/solvent phase, and
- removing said heater from said well, and
- removing the mobilized wax from said fluid passageways,
- whereby enough of said species of obstructing solid wax are removed from said fluid passageways to increase the permeability of said fluid passageways between said underground formation and said well to said crude oil.

9. A method of stimulating an oil well as claimed in claim 8 wherein said treatment area is the production zone of an underground well, and wherein the well has a metal tubing or casing and said step of energizing said heater comprises supplying power to a resistive heater which is positioned in said well, said power in said heater causing heat to be generated, said heat being transferred to said solvent having passing contact with said heater.

10. A method of stimulating an oil well as claimed in claim 9, including the steps of lowering said heater into said tubing, and placing a means for preventing convection circulation between said tubing and said casing.

11. A method as claimed in claim 10 wherein said step of placing said preventing means comprises placing a packer, gelled hydrocarbons or non condensable gas into an annulus defined between the tubing and the casing above the recovery zone.

12. A method as claimed in claim 1 or 8 wherein said step of directly heating said solvent includes restricting the maximum temperature of the solvent in the heater by means of a temperature sensing cut off switch.

13. The method of claim 1 or 8 wherein said step of directly heating said solvent includes passing the solvent past an electric heater, wherein said heat transfer is enhanced by the tortuous flow path of the solvent past the heater.

14. A method as claimed in claim 1 or 8 including the step of monitoring the temperature of the solvent as the solvent leaves the heater and adjusting the power dissipated in the heater in response to said monitored temperature.

15. A method as claimed in claim 1 or 8 further including the step of monitoring the temperature of the solvent as the solvent leaves the heater and adjusting the flowrate of the solvent in response to the monitored temperature.

16. A method as claimed in claim 1 or 8 wherein said solvent comprises a fluid which is miscible with melted wax and any hydrocarbon liquid being recovered from the well and by flowing said heated solvent into the treatment area the degree of saturation of the oil/wax/-solvent phase is increased, increasing the relative permeability of said phase and enhancing the removal of said phase from the treatment area.

17. A method as claimed in claim 1 or 8 wherein said heated solvent is left to stand in the treatment area for a period of time before the well is put back into production.

18. A method as claimed in claim 1 or 8 wherein said solvent comprises a fluid which is miscible with melted wax and any hydrocarbon liquid being recovered from the well and by flowing said heated solvent into the treatment area the degree of saturation of the oil/wax/-solvent phase is increased, thereby increasing the relative permeability of said phase and enhancing the removal of said phase from the treatment area and said solvent further includes one or more of an inhibitor, a surfactant, a dispersant, a viscosity control additive, or a crystal modifier.

* * * * *